US009666953B2

(12) United States Patent
Liu et al.

(10) Patent No.: US 9,666,953 B2
(45) Date of Patent: May 30, 2017

(54) CASSEGRAIN MICROWAVE ANTENNA

(75) Inventors: Ruopeng Liu, Shenzhen (CN); Chunlin Ji, Shenzhen (CN); Yutao Yue, Shenzhen (CN); Xiaoming Yin, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 209 days.

(21) Appl. No.: 14/235,058

(22) PCT Filed: Nov. 24, 2011

(86) PCT No.: PCT/CN2011/082819

§ 371 (c)(1),
(2), (4) Date: Apr. 18, 2014

(87) PCT Pub. No.: WO2013/013461

PCT Pub. Date: Jan. 31, 2013

(65) Prior Publication Data

US 2015/0364828 A1 Dec. 17, 2015

(30) Foreign Application Priority Data

Jul. 26, 2011 (CN) ..... 2011 1 0210398
Jul. 26, 2011 (CN) ..... 2011 1 0211007

(51) Int. Cl.
*H01Q 19/06* (2006.01)
*H01Q 15/00* (2006.01)
*H01Q 15/10* (2006.01)

(52) U.S. Cl.
CPC ..... *H01Q 19/062* (2013.01); *H01Q 15/0086* (2013.01); *H01Q 15/10* (2013.01); *H01Q 19/065* (2013.01)

(58) Field of Classification Search
CPC ..... H01Q 19/06; H01Q 19/08; H01Q 25/008; H01Q 15/02; H01Q 19/062
(Continued)

(56) References Cited

U.S. PATENT DOCUMENTS 7,218,285 B2 * 5/2007 Davis ..... H01Q 15/0086 343/753
7,538,946 B2 * 5/2009 Smith ..... B82Y 20/00 359/569
(Continued)

FOREIGN PATENT DOCUMENTS

CN 101183743 A 5/2008
CN 101794935 A 8/2010
(Continued)

*Primary Examiner* — Dieu H Duong
*Assistant Examiner* — Bamidele A Jegede
(74) *Attorney, Agent, or Firm* — Perkins Coie LLP

(57) ABSTRACT

Disclosed is a Cassegrain microwave antenna, which comprises a radiation source, a first metamaterial panel used for radiating an electromagnetic wave emitted by the radiation source, and a second metamaterial panel having an electromagnetic wave convergence feature and used for converting into plane wave the electromagnetic wave radiated by the first metamaterial panel. Employment of the principle of metamaterial for manufacturing the antenna allows the antenna to break away from restrictions of conventional concave lens shape, convex lens shape, and parabolic shape, thereby allowing the shape of the Cassegrain microwave antenna to be panel-shaped or any shape as desired, while allowing for reduced thickness, reduced size, and facilitated processing and manufacturing, thus providing beneficial effects of reduced costs and improved gain effect.

16 Claims, 11 Drawing Sheets

(58) Field of Classification Search
USPC ..... 343/753
See application file for complete search history.

(56) References Cited

U.S. PATENT DOCUMENTS

| | | | | |
|---|---|---|---|---|
| 7,570,432 | B1 * | 8/2009 | Yonak | G02B 3/0087 359/652 |
| 2009/0201572 | A1 * | 8/2009 | Yonak | G02B 1/00 359/316 |
| 2010/0046083 | A1 * | 2/2010 | Peng | B82Y 20/00 359/653 |
| 2010/0225562 | A1 * | 9/2010 | Smith | B82Y 20/00 343/909 |
| 2010/0277398 | A1 * | 11/2010 | Lam | H01Q 15/02 343/909 |
| 2011/0187601 | A1 * | 8/2011 | Ryou | H01Q 9/0407 343/700 MS |

FOREIGN PATENT DOCUMENTS

| | | | | | |
|---|---|---|---|---|---|
| CN | 101826657 | A | | 9/2010 | |
| CN | 201594587 | U | | 9/2010 | |
| CN | 101867094 | A | | 10/2010 | |
| CN | 102480024 | B | * | 3/2013 | G02B 1/002 |
| CN | 102480007 | B | * | 6/2013 | G02B 1/002 |

* cited by examiner

CASSEGRAIN MICROWAVE ANTENNA

FIELD OF THE INVENTION

The present invention relates to the antenna field, and in particular, to a back-feed microwave antenna.

BACKGROUND OF THE INVENTION

In a conventional optical device, by using a lens, spherical waves radiated from a point light source located at a focal point of the lens may be turned into plane waves after refraction of the lens. A lens antenna is an antenna that consists of a lens and a radiator placed on the focal point of the lens, and uses the lens to converge electromagnetic waves radiated from the radiator based on a converging property of the lens and emit the converged waves. This type of antenna is strong in directivity.

Currently, the convergence of the lens is achieved by refraction of a spherical shape of the lens. As shown in FIG. 1, spherical waves emitted from a radiator 1000 are emitted as plane waves after convergence by a spherical lens 2000. The inventors have identified that during the implementation of the present invention that, the lens antenna has at least the following technical problems: the spherical lens 1000 is large in volume and heavy, which is not favorable to miniaturization; the spherical lens 1000 depends heavily on the shape, and direction propagation of the antenna can be realized only when the shape is very accurate; and reflection interference and loss of the electromagnetic wave are quite severe, and electromagnetic energy is reduced. When the electromagnetic waves pass through boundary surfaces of different media, a phenomenon of partial reflection may happen. Usually, the larger the difference in electromagnetic parameter (permittivity or conductivity) between two media, the larger the reflection is. Due to reflection of partial electromagnetic waves, electromagnetic energy along a propagation direction may lose correspondingly, which seriously affects a propagation distance of electromagnetic signals and quality of transmitted signals.

SUMMARY OF THE INVENTION

In view of the defects in the prior art of being large in reflection loss and decreased in electromagnetic energy, a technical problem to be solved in the present invention is to provide a back-feed microwave antenna that is small in volume, good in antenna front-to-back ratio, high in gain, and long in transmission distance.

A technical solution employed by the present invention to solve the technical problem thereof is to propose a back-feed microwave antenna, which comprises a radiation source, a first metamaterial panel for diverging electromagnetic waves emitted by the radiation source, and a second metamaterial panel for converting the electromagnetic waves into plane waves; the first metamaterial panel comprises a first substrate and a plurality of third artificial metal microstructures or third artificial porous structures periodically arranged on the first substrate; the second metamaterial panel comprises a core layer, wherein the core layer comprises a plurality of core metamaterial sheets having the same refractive index distribution, each core metamaterial sheet comprises a circular area with a circle center of a center of a core metamaterial sheet substrate and a plurality of annular areas concentric with the circular area, refractive index variation ranges in the circular area and the annular areas are the same, wherein the refractive indexes continuously decrease from a maximum refractive index $n_p$ of the core metamaterial sheet to a minimum refractive index $n_0$ of the core metamaterial sheet with the increase of a radius, and refractive indexes at the same radius are the same; and the core metamaterial sheet comprises a core metamaterial sheet substrate and a plurality of first artificial metal microstructures or first artificial porous structures periodically arranged on the core metamaterial sheet substrate.

Further, the second metamaterial panel further comprises a first gradient metamaterial sheet to an $N^{th}$ gradient metamaterial sheet symmetrically arranged at both sides of the core layer, wherein two symmetrically arranged $N^{th}$ gradient metamaterial sheets are close to the core layer; maximum refractive indexes of the first gradient metamaterial sheet to the $N^{th}$ gradient metamaterial sheet respectively are $n_1$, $n_2$, $n_3$, . . . $n_n$, where $n_0<n_1<n_2<n_3 \ldots <n_n<n_p$; a maximum refractive index of an $a^{th}$ gradient metamaterial sheet is $n_a$, the $a^{th}$ gradient metamaterial sheet comprises a circular area with a circle center of a center of an $a^{th}$ gradient metamaterial sheet substrate and a plurality of annular areas concentric with the circular area, refractive index variation ranges in the circular area and the annular areas are the same, where the refractive indexes continuously decrease from a maximum refractive index $n_a$ of the $a^{th}$ gradient metamaterial sheet to the same minimum refractive index $n_0$ of all the gradient metamaterial sheets and core metamaterial sheets with the increase of the radius, and refractive indexes at the same radius are the same; each of the gradient metamaterial sheets comprises a gradient metamaterial sheet substrate and a plurality of second artificial metal microstructures periodically arranged on a surface of the gradient metamaterial sheet substrate; and all the gradient metamaterial sheets and all the core metamaterial sheets form a functional layer of the second metamaterial panel.

Further, the second metamaterial panel further comprises a first matching layer to an $M^{th}$ matching layer symmetrically arranged at both sides of the functional layer, wherein two symmetrically arranged $M^{th}$ matching layers are close to the first gradient metamaterial sheets; refractive index distribution of each matching layer is uniform, a refractive index of the first matching layer, which is close to the free space, is substantially equal to a refractive index of the free space, and a refractive index of the $M^{th}$ matching layer, which is close to the first gradient metamaterial sheet, is substantially equal to the minimum refractive index $n_0$ of the first gradient metamaterial sheet.

Further, start radii and end radii of the circular areas and annular areas concentric with the circular areas divided on all the gradient metamaterial sheets and all the core metamaterial sheets are the same; and a refractive index distribution relational expression of each gradient metamaterial sheet and all the core metamaterial sheets with the variation of a radius r is:

$$n_i(r) = \frac{i*n_p}{N+1} - \left(\frac{i}{(N+1)*d}\right)*\left(\sqrt{r^2+s^2} - \sqrt{L(j)^2+s^2}\right)*\frac{\left(n_p - \frac{N+1}{i}*n_0\right)}{n_p - n_0},$$

where an i value corresponding to the first gradient metamaterial sheet to the $N^{th}$ gradient metamaterial sheet is a number from 1 to N, all the i values corresponding to the core metamaterial sheets are N+1, s is a vertical distance from the radiation source to the first gradient metamaterial sheet, d is a total thickness of the first gradient metamaterial sheet to the $N^{th}$ gradient metamaterial sheet and all the core metamaterial sheets, $$d = \frac{\lambda}{n_p - n_0},$$

where λ is an operating wavelength of the second metamaterial panel; L(j) represents a start radius value of the circular areas on the core metamaterial sheets and the gradient metamaterial sheets and the plurality of annular areas concentric with the circular areas, and j represents which area, where L(1) represents a first area, namely, L(1)=0 in the circular area.

Further, a size variation rule of the plurality of the first artificial metal microstructures periodically arranged on the core metamaterial sheet substrate is that: the plurality of the first artificial metal microstructures are same in geometric shape, the core metamaterial sheet substrate comprises a circular area with a circle center of a center of the core metamaterial sheet substrate and a plurality of annular areas concentric with the circular area, size variation ranges of the first artificial metal microstructures in the circular area and the annular areas are the same, wherein the sizes continuously decrease from the maximum size to the minimum size with the increase of the radius, and sizes of first artificial metal microstructures at the same radius are the same.

Further, a first gradient metamaterial sheet to a third gradient metamaterial sheet are symmetrically arranged at both sides of the core layer; a size variation rule of the second artificial metal microstructures periodically arranged on the gradient metamaterial sheet substrate is that: a plurality of the second artificial metal microstructures are same in geometric shape, the gradient metamaterial sheet substrate comprises a circular area with a circle center of a center of the gradient metamaterial sheet substrate and a plurality of annular areas concentric with the circular area, size variation ranges of the second artificial metal microstructures in the circular area and the annular areas are the same, wherein the sizes continuously decrease from the maximum size to the minimum size with the increase of the radius, and sizes of second artificial metal microstructures at the same radius are the same.

Further, the first artificial porous structure is filled with a medium with a refractive index smaller than a refractive index of the core metamaterial sheet substrate, an arrangement rule of the plurality of first artificial porous structures periodically arranged on the core metamaterial sheet substrate is that: the core metamaterial sheet substrate comprises a circular area with a circle center of a center of the core metamaterial sheet substrate and a plurality of annular areas concentric with the circular area, volume variation ranges of the first artificial porous structures in the circular area and the annular areas are the same, wherein the volumes continuously increase from the minimum volume to the maximum volume with the increase of the radius, and first artificial pore volumes at the same radius are the same.

Further, the first artificial porous structure is filled with a medium with a refractive index larger than a refractive index of the core metamaterial sheet substrate, an arrangement rule of the plurality of first artificial porous structures periodically arranged on the core metamaterial sheet substrate is that: the core metamaterial sheet substrate comprises a circular area with a circle center of a center of the core metamaterial sheet substrate and a plurality of annular areas concentric with the circular area, volume variation ranges of the first artificial porous structures in the circular area and the annular areas are the same, wherein the volumes continuously decrease from the maximum volume to the minimum volume with the increase of the radius, and first artificial pore volumes at the same radius are the same.

Further, the second artificial porous structure is filled with a medium with a refractive index smaller than a refractive index of the gradient metamaterial sheet substrate, and an arrangement rule of the second artificial porous structures periodically arranged on the gradient metamaterial sheet substrate is that: the gradient metamaterial sheet substrate comprises a circular area with a circle center of a center of the gradient metamaterial sheet substrate and a plurality of annular areas concentric with the circular area, volume variation ranges of the second artificial porous structures in the circular area and the annular areas are the same, wherein the volumes continuously increase from the minimum volume to the maximum volume with the increase of the radius, and second artificial pore volumes at the same radius are the same.

Further, the plurality of first artificial metal microstructures, the plurality of second artificial metal microstructures and the plurality of third artificial metal microstructures have a same geometric shape.

Further, the geometric shape is an "I" shape, which comprises an upright first metal branch and second metal branches that are at both sides of the first metal branch and are perpendicular to the first metal branch.

Further, the geometric shape further comprises third metal branches that are at both ends of the second metal branches and are perpendicular to the second metal branches.

Further, the geometric shape is in a planar snowflake type, which comprises two mutually perpendicular first metal branches and second metal branches that are at both sides of the first metal branches and are perpendicular to the first metal branches.

Further, refractive indexes of the first metamaterial panel are distributed in a form of circle with a circle center of a central point of the first metamaterial panel, a refractive index at the circle center is minimum, the refractive index of a corresponding radius increases with the increase of the radius, and refractive indexes at the same radius are the same.

Further, the first metamaterial panel consists of a plurality of first metamaterial sheets having the same refractive index distribution; the third artificial metal microstructures are distributed in a form of circle on the first substrate with a circle center of a central point of the first metamaterial panel, a size of the third artificial metal microstructure at the circle center is minimum, sizes of third artificial metal microstructures at a corresponding radius increase with the increase of the radius, and sizes of third artificial metal microstructures at the same radius are the same.

Further, the first metamaterial panel consists of a plurality of first metamaterial sheets having the same refractive index distribution; the third artificial porous structure is filled with a medium with a refractive index smaller than a refractive index of the first substrate, an arrangement the rule of third artificial porous structures periodically arranged on the first substrate is that: the central point of the first metamaterial panel is taken as the circle center, a volume of the third artificial porous structure at the circle center is minimum, volumes of third artificial porous structures at the same radius are the same, and third artificial porous structure volumes increase with the increase of the radius.

Further, the back-feed microwave antenna further comprises a housing, wherein the housing and the second metamaterial panel form a sealed cavity, and a wave-absorbing material is further attached inside a housing wall connected with the second metamaterial panel.

Further, the first metamaterial panel is fixed in front of the radiation source by using a bracket, and a distance from the radiation source to the first metamaterial panel is 30 cm.

The technical solution of the present invention has the following beneficial effects: the electromagnetic waves emitted by the radiation source are converted into plane waves by designing refractive index variation of and inside the core layer and gradient layer of the metamaterial panel, so that converging performance of the antenna is improved, reflection loss is significantly reduced, thereby preventing electromagnetic energy from reducing, increasing the transmission distance, and improving the antenna performance. Further, the metamaterial having the diverging function is further disposed in front of the radiation source, thereby improving the near field radiation range of the radiation source, so that the back-feed microwave antenna may have a smaller overall size. Furthermore, in the present invention, the metamaterial is formed by using the artificial metal microstructures or artificial porous structures, and the present invention achieves the beneficial effects of simple process and low cost.

BRIEF DESCRIPTION OF THE DRAWINGS

The technical solutions of the present invention are further described with reference to attached drawings and embodiments. Among the attached drawings.

DETAILED DESCRIPTION OF THE INVENTION

Light is a type of the electromagnetic wave. When light passes through glass, since a wavelength of a light ray is much larger than a size of an atom, a response of the glass to the light ray may be described by using an overall parameter of the glass, such as a refractive index, rather than specific parameters of the atom of the glass. Correspondingly, when a response of a material to another electromagnetic wave is studied, the response of any structure in the material with a size much smaller than the wavelength of the electromagnetic wave to the electromagnetic wave may also be described by using the overall parameter of the material, such as a permittivity $\epsilon$ and a conductivity $\mu$. The structure of each point of the material is designed to make the permittivity and conductivity of each point of the material same or different, so that the overall permittivity and conductivity of the material are arranged according to a certain rule. The conductivity and permittivity arranged according to a rule may enable the material to make a macroscopic response to the electromagnetic wave, for example, converging the electromagnetic wave or diverging the electromagnetic wave. This type of material having a conductivity and a permittivity arranged according to a rule is called a metamaterial.

Figure 1:
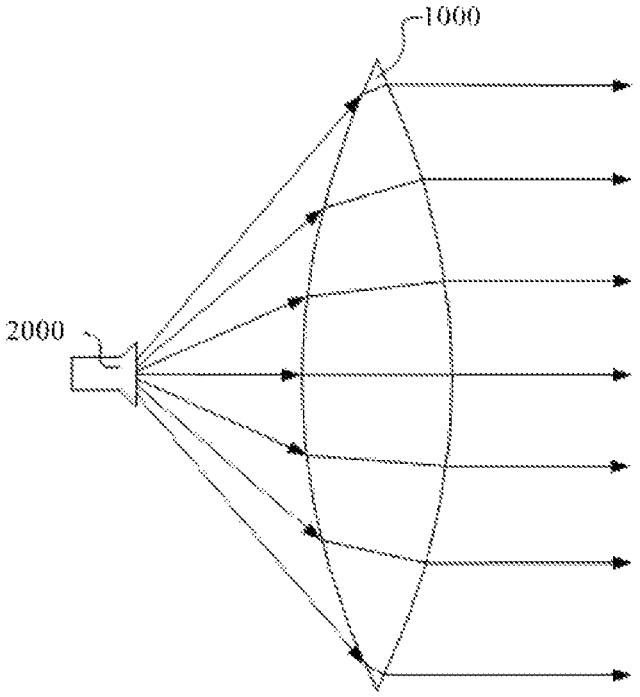
FIG. 1 is a schematic view of converging electromagnetic waves by a lens antenna in a spherical shape in the prior art.
Figure 2:
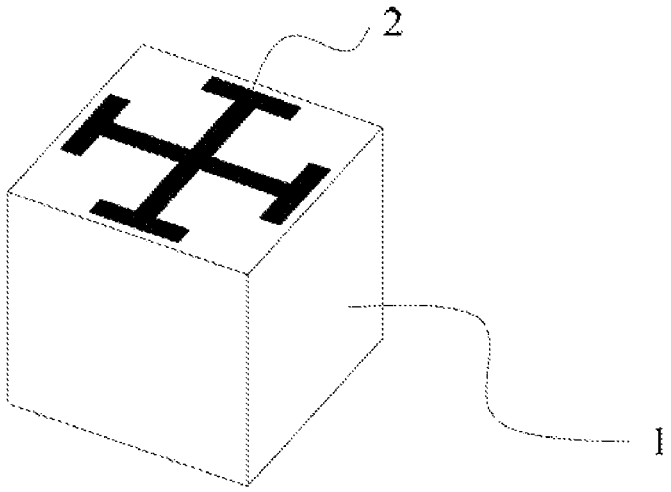
FIG. 2 is a schematic three-dimensional structural view of a basic unit forming a metamaterial according to a first embodiment of the present invention.

As shown in FIG. 2, FIG. 2 is a schematic three-dimensional structural view of a basic unit forming a metamaterial according to a first embodiment of the present invention. The metamaterial basic unit comprises an artificial microstructure 1 and a substrate 2 where the artificial microstructure is attached. In the present invention, the artificial microstructure is an artificial metal microstructure. The artificial metal microstructure has a planar or three-dimensional topology structure capable of responding to an electric field and/or magnetic field of the incident electromagnetic wave. A response of each metamaterial basic unit to the incident electromagnetic wave may be changed by changing a pattern and/or size of the artificial metal microstructure on each metamaterial basic unit. The metamaterial may make a macroscopic response to the electromagnetic wave by arranging a plurality metamaterial basic units according to a certain rule. Since the metamaterial entirely needs to make a macroscopic electromagnetic response to the incident electromagnetic wave, the responses made by the metamaterial basic units to the incident electromagnetic wave need to form a continuous response. Therefore, it is required that the size of each metamaterial basic unit is from 1/10 to 1/5 of the wavelength of the incident electromagnetic wave, and preferably is 1/10 of the wavelength of the incident electromagnetic wave. In the description, the entire metamaterial is artificially divided into a plurality of metamaterial basic units. However, it should be known that such division is merely for convenience of description, and the metamaterial should not be considered as being spliced or assembled by using a plurality of metamaterial basic units. In practice, a metamaterial is formed by periodically arranging artificial metal microstructures on a substrate. Therefore, the process is simple and the cost is low. Periodical arrangement is such that the artificial metal microstructures on each artificially divided metamaterial basic unit can generate a continuous electromagnetic response to the incident electromagnetic wave.

Figure 3:
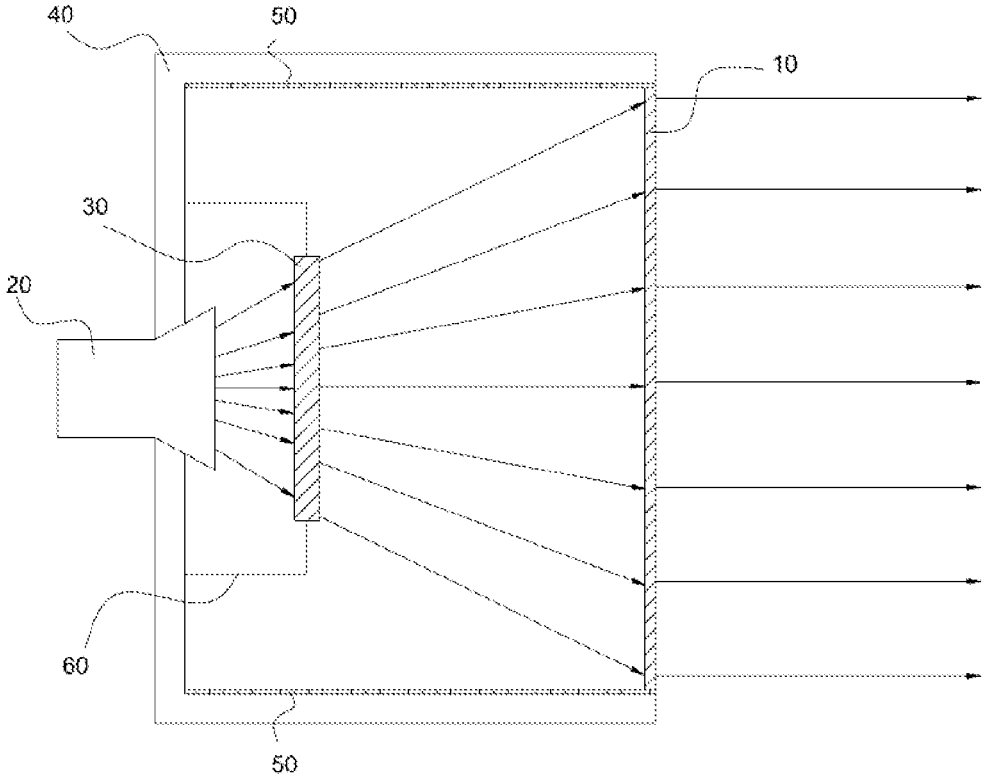
FIG. 3 is a schematic structural view of a back-feed microwave antenna according to the first embodiment of the present invention.

As shown in FIG. 3, FIG. 3 is a schematic structural view of a back-feed microwave antenna according to a first embodiment of the present invention. In FIG. 3, the back-feed microwave antenna of the present invention comprises a radiation source 20, a first metamaterial panel 30, a second metamaterial panel 10 and a housing 40. In the present invention, a frequency of electromagnetic waves emitted by the radiation source 20 is from 12.4 GHz to 18 GHz. The second metamaterial panel 10 and the housing 40 form a sealed cavity. In FIG. 3, the sealed cavity is cuboid-shaped, but in practice, since a size of the radiation source 20 is smaller than a size of the second metamaterial panel 10, the sealed cavity is usually conical. A wave-absorbing material 50 is arranged inside a housing wall connected with the second metamaterial panel 10. The wave-absorbing material 50 may be a conventional wave-absorbing coating or a wave-absorbing sponge. The electromagnetic waves partially radiated from the radiation source 20 to the wave-absorbing material 50 are absorbed by the wave-absorbing material 50 to enhance a front-to-back ratio of the antenna. In addition, the housing opposite to the second metamaterial panel 10 is made of metal or a macromolecular material. The electromagnetic waves partially radiated from the radiation source 20 to the housing of metal or macromolecular metamaterial are reflected to the second metamaterial panel 10 or the first metamaterial panel 30 to further enhance the front-to-back ratio of the antenna. Further, an antenna protective cover (not shown) is arranged in a distance of half a wavelength from the second metamaterial panel 10. The antenna protective cover protects the second metamaterial panel from being affected by external environment. The half a wavelength herein refers to a half of the wavelength of the electromagnetic wave emitted by the radiation source 20.

Figure 4:
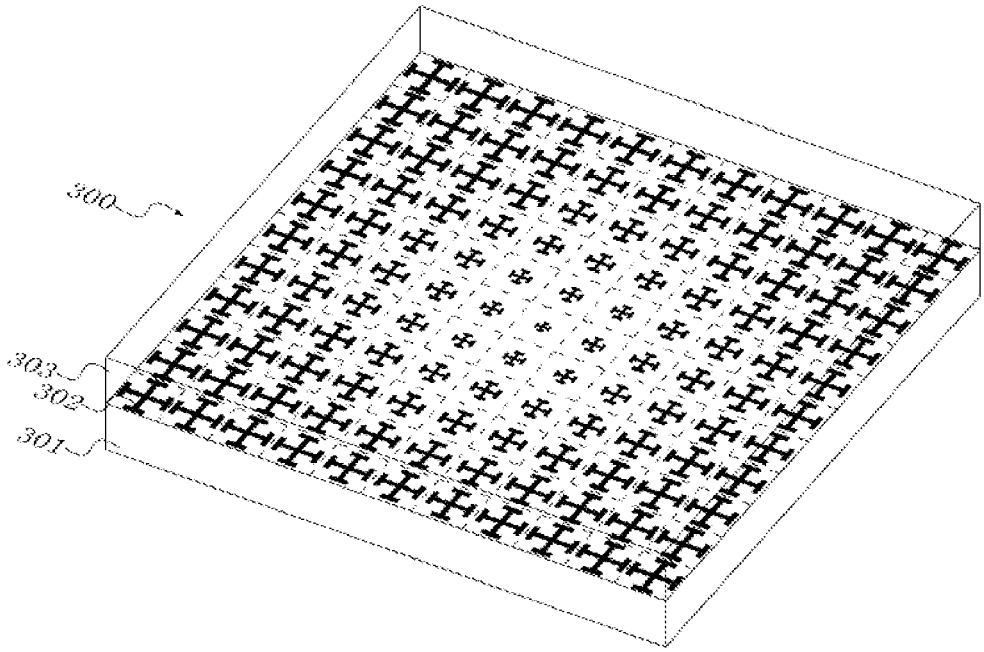
FIG. 4 is a schematic structural view of a first metamaterial sheet forming a first metamaterial panel in the back-feed microwave antenna according to the first embodiment of the present invention.

The first metamaterial panel 30 may be directly attached to a radiation port of the radiation source 20. However, when the first metamaterial panel 30 is directly attached to the radiation port of the radiation source 20, the electromagnetic waves radiated from the radiation source 20 may be partially reflected by the first metamaterial panel 30, which causes energy loss. Therefore, in the present invention, the first metamaterial panel 30 is fixed in front of the radiation source 20 by using a bracket 60. Preferably, a spacing distance between the first metamaterial panel 30 and the radiation source 20 is 30 cm. The first metamaterial panel 30 consists of a plurality of first metamaterial sheets 300 having the same refractive index distribution. As shown in FIG. 4, FIG. 4 is a schematic three-dimensional structural view of the first metamaterial sheet 300 according to the first embodiment of the present invention. In order to clearly introduce the first metamaterial sheet 300, FIG. 4 adopts perspective drawing. The first metamaterial sheet 300 comprises a first substrate 301 and a plurality of third artificial metal microstructures 302 periodically arranged on the first substrate. Preferably, a coating layer 303 is further covered on the plurality of third artificial metal microstructures 302 to encapsulate the third artificial metal microstructures 302. The coating layer 303 and the first substrate 301 are same in the material and thickness. In the present invention, the thickness of the coating layer 303 and the first substrate 301 is 0.4 mm, and a thickness of the artificial metal microstructure layer is 0.018 mm. Therefore, the thickness of the whole first metamaterial sheet is 0.818 mm. It can be seen from this number that, all the thicknesses of the metamaterial sheets have a great advantage over those of a conventional convex lens antenna.

The basic units forming the first metamaterial sheet 300 are still as shown in FIG. 2, but the first metamaterial sheet 300 needs to have a function of diverging the electromagnetic waves. Based on theory of electromagnetism, the electromagnetic waves deflect towards the direction with a large refractive index. Therefore, a variation rule of refractive indexes of the first metamaterial sheet 300 is that: the refractive indexes of the first metamaterial sheet 300 are distributed in a form of circle, a refractive index at the circle center is minimum, the refractive index of a corresponding radius increases with the increase of the radius, and refractive indexes at the same radius are the same. The first metamaterial sheet 300 having this type of refractive index distribution diverges the electromagnetic waves radiated from the radiation source 20, thereby improving the near field radiation range of the radiation source, so that the back-feed microwave antenna may have a smaller overall size.

More specifically, in the present invention, the refractive index distribution rule of the first metamaterial sheet 300 may be linear variation, that is, $n_{(R)}=n_{min}+KR$, where K is a constant, R is a wiring distance between a central point of the metamaterial basic units, which are attached by the third artificial metal microstructures and distributed in a form of circle, and a central point of the first substrate, and $n_{min}$ is a refractive index value of the central point of the first substrate. In addition, the refractive index distribution rule of the first metamaterial sheet 300 may also be square variation, that is, $n_{(R)}=n_{min}+KR^2$; or cubic variation, that is, $n_{(R)}=n_{min}+KR^3$; or power function variation, that is, $n_{(R)}=n_{min}*K^R$. It can be known from the formula for the variation of the first metamaterial sheet 300 that, the formula can be used as long as the first metamaterial sheet 300 can diverge the electromagnetic waves emitted by the radiation source.

Figure 5:
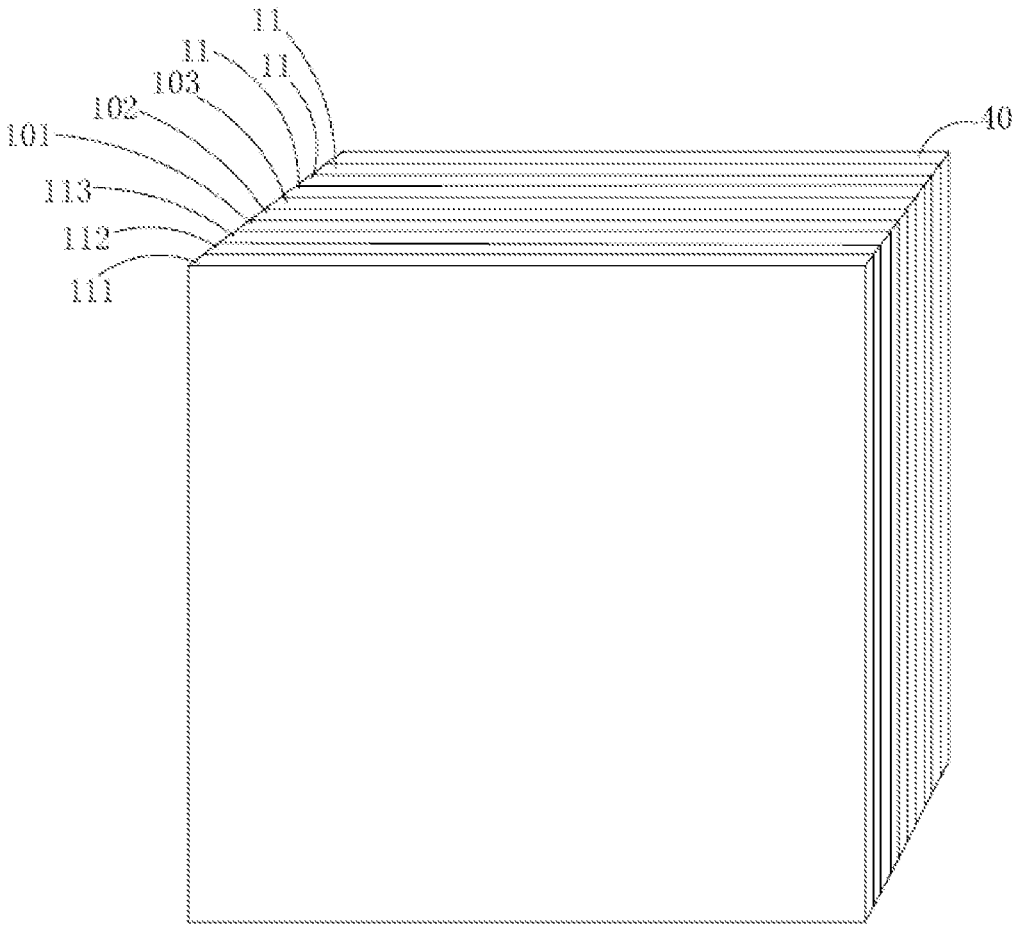
FIG. 5 is a schematic three-dimensional structural view of a second metamaterial panel in the back-feed microwave antenna according to the first embodiment of the present invention.

The second metamaterial panel of the back-feed microwave antenna of the present invention will be described in detail below. The second metamaterial panel converges the electromagnetic waves diverged by the first metamaterial panel, and then the diverged spherical electromagnetic waves are radiated out in a form of plane electromagnetic waves which are more suitable for long distance transmission. As shown in FIG. 5, FIG. 5 is a schematic three-dimensional structural view of the second metamaterial panel according to the first embodiment of the present invention. In FIG. 5, the second metamaterial panel 10 comprises a core layer, wherein the core layer consists of a plurality of core metamaterial sheets 11 having the same refractive index distribution; and a first gradient metamaterial sheet 101 to an $N^{th}$ gradient metamaterial sheet symmetrically arranged at both sides of the core layer. In this embodiment, the gradient metamaterial sheets are a first gradient metamaterial sheet 101, a second gradient metamaterial sheet 102 and a third gradient metamaterial sheet 103. All the gradient metamaterial sheets and all the core metamaterial sheets form a functional layer of the second metamaterial panel. The second metamaterial panel 10 comprises a first matching layer 111 to an $M^{th}$ matching layer symmetrically arranged at both sides of the functional layer. The refractive index distribution of each matching layer is uniform, a refractive index of the first matching layer 111, which is close to free space, is substantially equal to a refractive index of the free space, and a refractive index of the last matching layer, which is close to the first gradient metamaterial sheet, is substantially equal to the minimum refractive index of the first gradient metamaterial sheet 101. In this embodiment, the matching layer comprises a first matching layer 111, a second matching layer 112 and a third matching layer 113. Both the gradient metamaterial sheets and the matching layers have the functions of reducing reflection of electromagnetic waves and impedance matching and phase compensation. Therefore, it is a more preferable implementation manner to arrange the gradient metamaterial sheets and the matching layers.

The matching layer is similar to the first metamaterial sheet in the structure, and consists of a coating layer and a substrate. The difference from the first metamaterial sheet lies in that, air is filled fully between the coating layer and the substrate, a duty ratio of air is changed by changing a space between the coating layer and the substrate, thereby enabling the matching layers to have different refractive indexes.

The basic units forming the core metamaterial sheet and the gradient metamaterial sheet are as shown in FIG. 2. Further, in the present invention, in order to simplify the manufacturing process, sizes and structures of the core metamaterial sheet and the gradient metamaterial sheet are the same as those of the first metamaterial sheet. That is, each core metamaterial sheet and each gradient metamaterial sheet consist of a coating layer of 0.4 mm, a substrate of 0.4 mm, and an artificial metal microstructure of 0.018 mm. In addition, in the present invention, geometric shapes of the first artificial metal microstructure, the second artificial metal microstructure, and the third artificial metal microstructure, which respectively form the core metamaterial sheet, the gradient metamaterial sheet, and the first metamaterial sheet, are the same.

Both the core metamaterial sheet and the gradient metamaterial sheet are divided into a circular area and a plurality of annular areas concentric with the circular area, refractive indexes of the circular area and the annular area continuously decrease from the maximum refractive index of each lamella to $n_0$ with the increase of the radius, and refractive index values of metamaterial basic units at the same radius are the same. The maximum refractive index of the core metamaterial sheet is $n_p$, the maximum refractive indexes of the first gradient metamaterial sheet to the $N^{th}$ gradient metamaterial sheet respectively are $n_1, n_2, n_3, \ldots n_n$, where $n_0<n_1<n_2<n_3< \ldots <n_n<n_p$. Start radii and end radii of the circular areas and annular areas concentric with the circular areas divided on all the gradient metamaterial sheets and all the core metamaterial sheets are the same. A refractive index distribution relational expression of each gradient metamaterial sheet and all the core metamaterial sheets with the variation of a radius r is:

$$n_i(r) = \frac{i*n_p}{N+1} - \left(\frac{i}{(N+1)*d}\right)*\left(\sqrt{r^2+s^2} - \sqrt{L(j)^2+s^2}\right)*\frac{\left(n_p - \frac{N+1}{i}*n_0\right)}{n_p - n_0},$$

where an i value corresponding to the first gradient metamaterial sheet to the $N^{th}$ gradient metamaterial sheet is a number from 1 to N, all the i values corresponding to the core layer are N+1, s is a vertical distance from the radiation source to the first gradient metamaterial sheet, d is a total thickness of the first gradient metamaterial sheet to the $N^{th}$ gradient metamaterial sheet and all the core metamaterial sheets, $$d = \frac{\lambda}{n_p - n_0},$$

where λ is an operating wavelength of the second metamaterial panel. The operating wavelength of the second metamaterial panel is determined in practice. It can be known from the description for the metamaterial sheets that, in this embodiment, a thickness of each metamaterial sheet is 0.818 mm. The value of d may be determined after the operating wavelength of the second metamaterial panel is determined, so that the number of the metamaterial sheets manufactured in practice can be obtained. L(j) represents a start radius value of the circular areas on the core metamaterial sheets and the gradient metamaterial sheets and the plurality of annular areas concentric with the circular areas, and j represents which area, where L(1) represents a first area, namely, L(1)=0 in the circular area.

A preferred method for determining the L(j) will be discussed below. Electromagnetic waves radiated from the radiation source are incident into the first gradient metamaterial sheet. Optical paths passed by the electromagnetic waves incident into the first gradient metamaterial sheet are not equal because of different emergence angles. s is a vertical distance from the radiation source to the first gradient metamaterial sheet, and also is the shortest optical path passed by the electromagnetic waves incident into the first gradient metamaterial sheet. At this time, the incidence point corresponds to the circular area start radius of the first gradient metamaterial sheet. That is, when j=1, correspondingly L(1)=0. When a certain beam of electromagnetic waves emitted by the radiation source is incident into the first gradient metamaterial sheet, and the optical path it passed is s+λ, a distance between the incident point of this beam of electromagnetic waves and the incidence point of vertical incidence is the start radius of the first annular area of the plurality of annular areas, and is also an end radius of the circular area. It can be known based on the mathematical formula that, when j=2, correspondingly $L(2)=\sqrt{(s+\lambda)^2-s^2}$, where λ is a wavelength value of an incident electromagnetic wave. When a certain beam of electromagnetic waves emitted by the radiation source is incident into the first gradient metamaterial sheet, and the optical path it passed is s+2λ, a distance between the incident point of this beam of electromagnetic waves and the incidence point of vertical incidence is the start radius of the second annular area of the plurality of annular areas, and is also an end radius of the first annular area. It can be known based on the mathematical formula that, when j=3, correspondingly L(3)=

$\sqrt{(s+2\lambda)^2-s^2}$. In a similar manner, the start radii and end radii of the circular area and the annular areas concentric with the circular area can be known.

Figure 6:
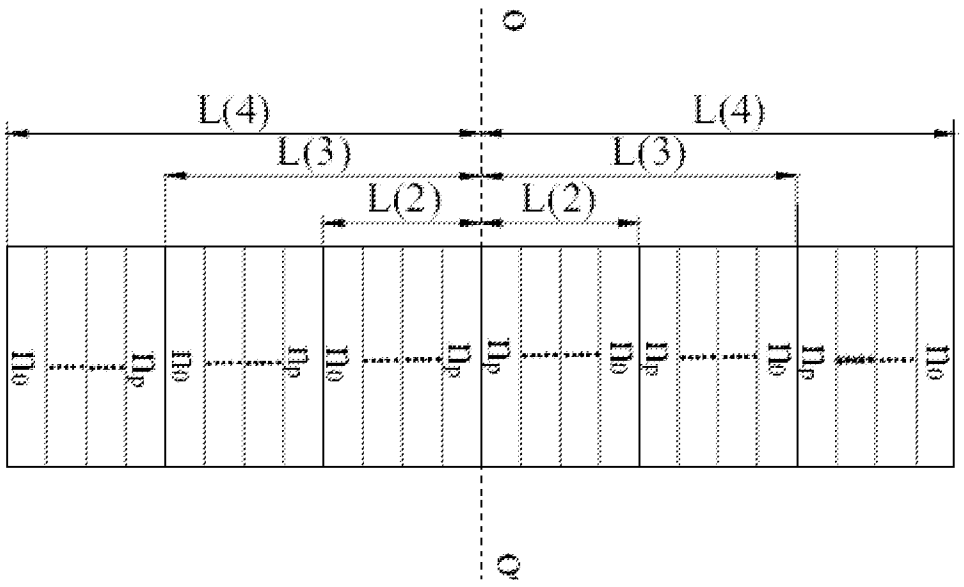
FIG. 6 is a schematic view of refractive index distribution of a core layer of the second metamaterial panel that varies with a radius in the back-feed microwave antenna according to the first embodiment of the present invention.

In order to express the above variation rule in a more intuitive manner, FIG. 6 shows a schematic view of refractive indexes of the core layer that vary with the radius. In FIG. 6, the refractive index of each area gradually changes from $n_p$ to $n_0$, and the start radii and end radii of each area are given according to the above relational expression of L(j). FIG. 6 merely shows variation ranges of three areas, namely, areas L(2) to L(4). However, it should be known that they are merely illustrative, and the start end radii of any area can be deduced by applying the above L(j) based on requirements in practice. The schematic view of refractive indexes of the gradient layer that vary with the radius is similar to FIG. 6, and a difference merely lies in that the maximum value is a refractive index maximum value of the gradient layer rather than $n_p$.

In the present invention, the second metamaterial panel comprises a core layer composed of three core metamaterial sheets having the same refractive index distribution, three gradient metamaterial sheets are symmetrically arranged at both sides of the core layer, the nine metamaterial sheets form a functional layer of the second metamaterial panel. Three matching layers with uniform refractive index distribution are symmetrically arranged at both sides of the functional layer. The maximum refractive index that can be reached by the core layer of the second metamaterial panel is 6.42, and the minimum refractive index that can be reached is 1.45. In order to make reflected energy during the incidence of the incident electromagnetic waves is little, in this embodiment, a total thickness of the three matching layers is 0.46 mm, the refractive indexes respectively are 1.15, 1.3, and 1.45. The refractive index distribution of the core metamaterial sheet and the three gradient metamaterial sheets at one side of the core metamaterial sheet can be solved from the above formula, wherein the distance from the radiation source to the first matching layer is 0.3 meters. That is, the distance from the radiation source to the first gradient metamaterial sheet is 0.3046 meters, and the overall thickness of the second metamaterial panel is (0.46*2+0.818*9)=8.282 mm. An overall height of the second metamaterial panel is 0.6 meters. It can be known from the thickness and height of the second metamaterial panel that, compared with the conventional lens antenna, the antenna made of the metamaterial is lighter, thinner, and smaller in volume.

The overall refractive index distribution relationship between the first metamaterial panel and the second metamaterial panel are discussed in detail above. It can be known from the metamaterial principle that, the size and pattern of the artificial metal microstructures attached on the substrate directly determine refractive index values of different points of the metamaterial. In addition, it can be known from experiments that, when the artificial metal microstructures are in a same geometric shape, and the larger the size, the larger the refractive index of the corresponding metamaterial basic unit will be. In the present invention, since geometric shapes of the plurality of first artificial metal microstructure, the plurality of second artificial metal microstructure, and the plurality of third artificial metal microstructures are the same, an arrangement rule of the third artificial metal microstructures on the first metamaterial sheet forming the first metamaterial panel is that: a plurality of third artificial microstructures are the third artificial metal microstructures and are same in geometric shape, the third artificial metal microstructures are distributed in a form of circle on the first substrate with a circle center of the central point of the first substrate, a size of the third artificial metal microstructure at the circle center is minimum, sizes of third artificial metal microstructures at a corresponding radius increase with the increase of the radius, and sizes of third artificial metal microstructures at the same radius are the same. An arrangement rule of the second artificial metal microstructures on the gradient metamaterial sheet is that: the plurality of second artificial metal microstructures are same in geometric shape, the gradient metamaterial sheet substrate comprises a circular area with a circle center of a central point of the gradient metamaterial sheet substrate and a plurality of annular areas concentric with the circular area, size variation ranges of the second artificial metal microstructures in the circular area and the annular areas are the same, wherein the sizes continuously decrease from the maximum size to the minimum size with the increase of the radius, and sizes of second artificial metal microstructures at the same radius are the same. An arrangement rule of the first artificial metal microstructures on the core metamaterial sheet is that: the plurality of first artificial metal microstructures are same in geometric shape, the core metamaterial sheet substrate comprises a circular area with a circle point of a central point of the core metamaterial sheet substrate and a plurality of annular areas concentric with the circular area, size variation ranges of the first artificial metal microstructures in the circular area and the annular areas are the same, wherein the sizes continuously decrease from the maximum size to the minimum size with the increase of the radius, and sizes of first artificial metal microstructures at the same radius are the same.

There are various geometric shapes of the artificial metal microstructures that meet the above refractive index distribution requirements of the first metamaterial panel and the second metamaterial panel, basically these geometric shapes are capable of responding to the incident electromagnetic waves, and the most typical one is an "I" shaped artificial metal microstructures. Several geometric shapes of the artificial metal microstructure will be described in detail below. The size of the artificial metal microstructure can be adjusted according to the required maximum refractive index and minimum refractive index on the first metamaterial panel and the second metamaterial panel, so as to meet the requirements. The adjustment manner may be computer simulation or hand computation, and details will not be described because it is not the key point of the present invention.

Figure 7:
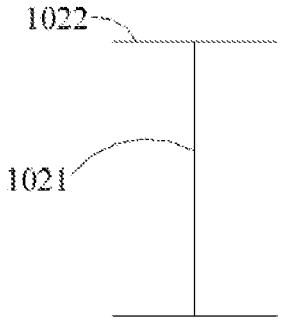
FIG. 7 is a topology pattern of a geometric shape of an artificial metal microstructure in a first preferred implementation manner that is capable of responding to electromagnetic waves to change refractive indexes of metamaterial basic units according to the first embodiment of the present invention.
Figure 8:
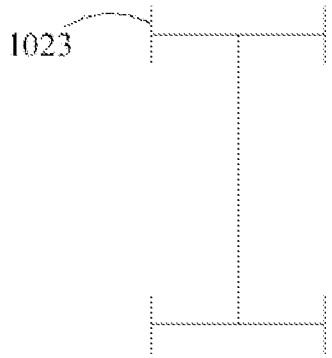
FIG. 8 is a pattern derived from the topology pattern of the geometric shape of the artificial metal microstructure in FIG. 7.

As shown in FIG. 7, FIG. 7 is a topology pattern of a geometric shape of an artificial metal microstructure in a first preferred implementation manner that is capable of responding to electromagnetic waves to change refractive indexes of metamaterial basic units according to the first embodiment of the present invention. In FIG. 7, the artificial metal microstructure is in an "I" shape, which comprises an upright first metal branch 1021 and second metal branches 1022 that are respectively perpendicular to the first metal branch 1021 and are at both ends of the first metal branch. FIG. 8 is a pattern derived from the topology pattern of the geometric shape of the artificial metal microstructure in FIG. 7, and the pattern not only comprises the first metal branch 1021 and the second metal branches 1022, but also comprises third metal branches 1023 perpendicularly arranged at both sides of the second metal branches.

Figure 9:
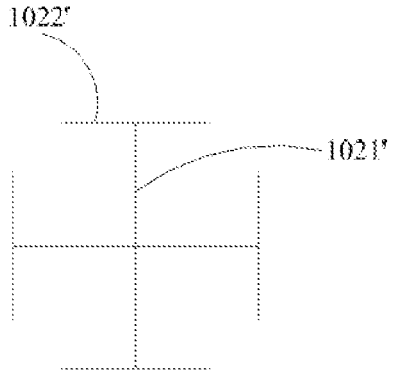
FIG. 9 is a topology pattern of a geometric shape of an artificial metal microstructure in a second preferred implementation manner that is capable of responding to electromagnetic waves to change refractive indexes of metamaterial basic units according to the first embodiment of the present invention.
Figure 10:
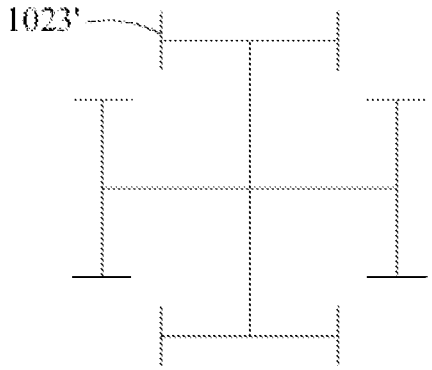
FIG. 10 is a pattern derived from the topology pattern of the geometric shape of the artificial metal microstructure in FIG. 9.

FIG. 9 is a topology pattern of a geometric shape of an artificial metal microstructure in a second preferred implementation manner that is capable of responding to electromagnetic waves to change refractive indexes of metamaterial basic units according to the first embodiment of the present invention. In FIG. 9, the artificial metal microstructure is in a planar snowflake type, which comprises mutually perpendicular first metal branches 1021' and second metal branches 1022' perpendicularly arranged at both ends of the two first metal branches 1021'. FIG. 10 is a pattern derived from the topology pattern of the geometric shape of the artificial metal microstructure in FIG. 9, and the pattern not only comprises two first metal branch 1021', four second metal branches 1022', but also comprises third metal branches 1023' perpendicularly arranged at both ends of the four second metal branches. Preferably, the first metal branches 1021' are equal in length, and are perpendicular and intersect at the midpoint, the second metal branches 1022' are equal in length, and midpoints are located at endpoints of the first metal branches, the third metal branches 1023' are equal in length, and midpoints are located at endpoints of the second metal branches. The above metal branches are arranged to make the artificial metal microstructures isotropous. That is, if the artificial metal microstructure is rotated by 90° in a plane of the artificial metal microstructure in any direction, the rotated artificial metal microstructure may coincide with the original artificial metal microstructure. The isotropous artificial metal microstructures may be adopted to simplify the design and reduce the interference.

Figure 11:
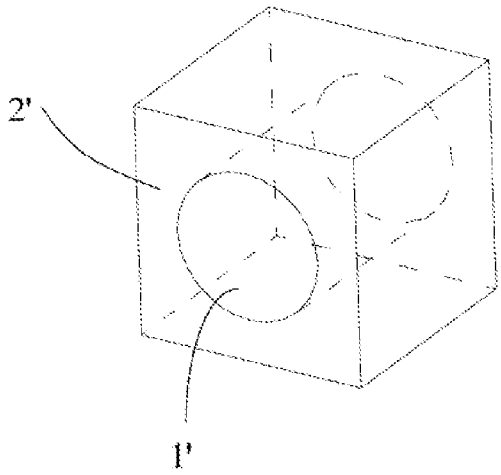
FIG. 11 is a schematic three-dimensional structural view of a basic unit forming a metamaterial according to a second embodiment of the present invention.

As shown in FIG. 11, FIG. 11 is a schematic three-dimensional structural view of a basic unit forming a metamaterial according to the second embodiment of the present invention.

The metamaterial basic unit comprises a substrate 2' and an artificial porous structure 1' formed on the substrate 2'. Forming the artificial porous structure 1' on the substrate 2' makes a permittivity and a conductivity substrate of the substrate 2' change with the change of a volume of the artificial porous structure, so that each metamaterial basic unit generates different electromagnetic responses to incident waves of a same frequency. The metamaterial may make a macroscopic response to the electromagnetic wave by arranging a plurality metamaterial basic units according to a certain rule. Since the metamaterial entirely needs to make a macroscopic electromagnetic response to the incident electromagnetic wave, the responses made by the metamaterial basic units to the incident electromagnetic wave need to form a continuous response. Therefore, it is required that the size of each metamaterial basic unit is from 1/10 to 1/5 of wavelength of the incident electromagnetic wave, and preferably is 1/10 of the wavelength of the incident electromagnetic wave. In the description, the entire metamaterial is artificially divided into a plurality of metamaterial basic units. However, it should be known that such division is merely for convenience of description, and the metamaterial should not be considered as being spliced or assembled by using a plurality of metamaterial basic units. In practice, a metamaterial is formed by periodically arranging artificial metal microstructures on a substrate. Therefore, the process is simple and the cost is low. Periodical arrangement is such that the artificial porous structures on each artificially divided metamaterial basic unit can generate a continuous electromagnetic response to the incident electromagnetic wave.

Figure 12:
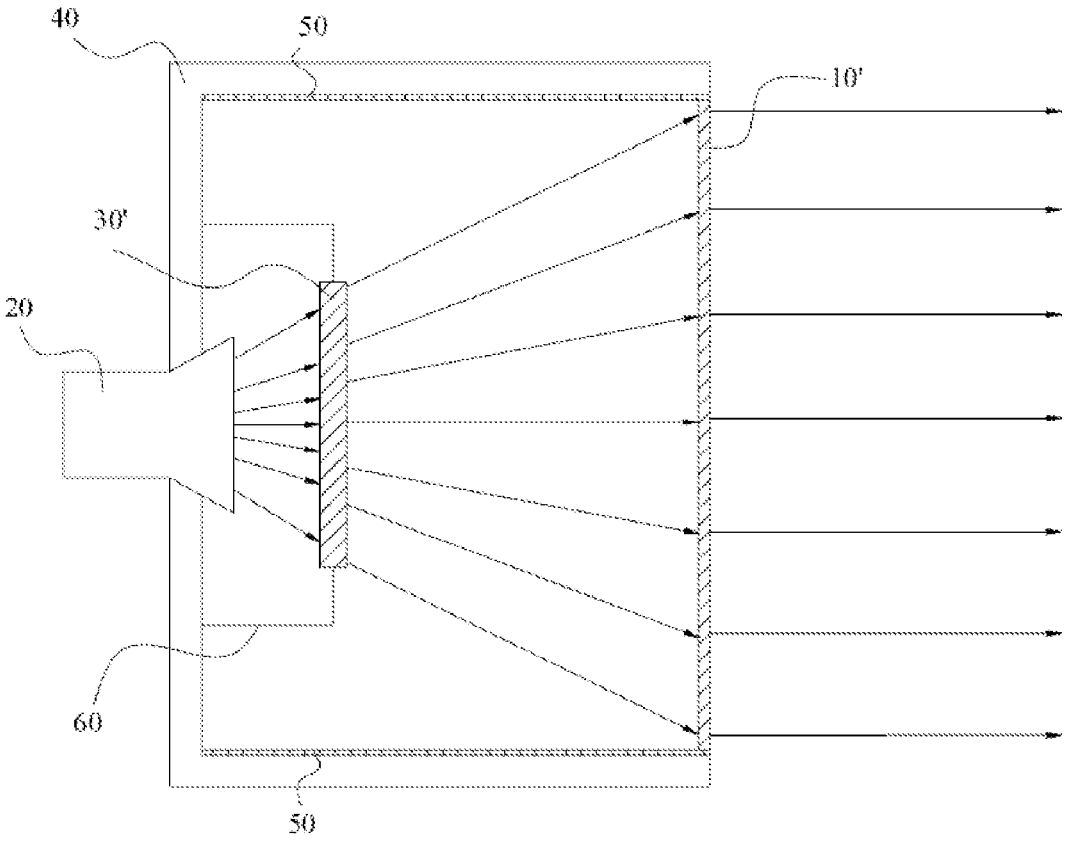
FIG. 12 is a schematic structural view of a back-feed microwave antenna according to the second embodiment of the present invention.

As shown in FIG. 12, FIG. 12 is a schematic structural view of a back-feed microwave antenna according to a second embodiment of the present invention. In FIG. 12, the back-feed microwave antenna of the present invention comprises a radiation source 20, a first metamaterial panel 30', a second metamaterial panel 10' and a housing 40. In the present invention, a frequency of electromagnetic waves emitted by the radiation source 20 is from 12.4 GHz to 18 GHz. The second metamaterial panel 10' and the housing 40 form a sealed cavity. In FIG. 12, the sealed cavity is cuboid-shaped, but in practice, since a size of the radiation source 20 is smaller than a size of the second metamaterial panel 10', the sealed cavity is usually conical. A wave-absorbing material 50 is arranged inside a housing wall connected with the second metamaterial panel 10'. The wave-absorbing material 50 may be a conventional wave-absorbing coating or a wave-absorbing sponge. The electromagnetic waves partially radiated from the radiation source 20 to the wave-absorbing material 50 are absorbed by the wave-absorbing material 50 to enhance a front-to-back ratio of the antenna. In addition, the housing opposite to the second metamaterial panel 10' is made of metal or a macromolecular material. The electromagnetic waves partially radiated from the radiation source 20 to the housing of metal or macromolecular metamaterial are reflected to the second metamaterial panel 10' or the first metamaterial panel 30' to further enhance the front-to-back ratio of the antenna. Further, an antenna protective cover (not shown) is arranged in a distance of half a wavelength from the second metamaterial panel 10'. The antenna protective cover protects the second metamaterial panel from being affected by external environment. The half a wavelength herein refers to a half of the wavelength of the electromagnetic wave emitted by the radiation source 20.

Figure 13:
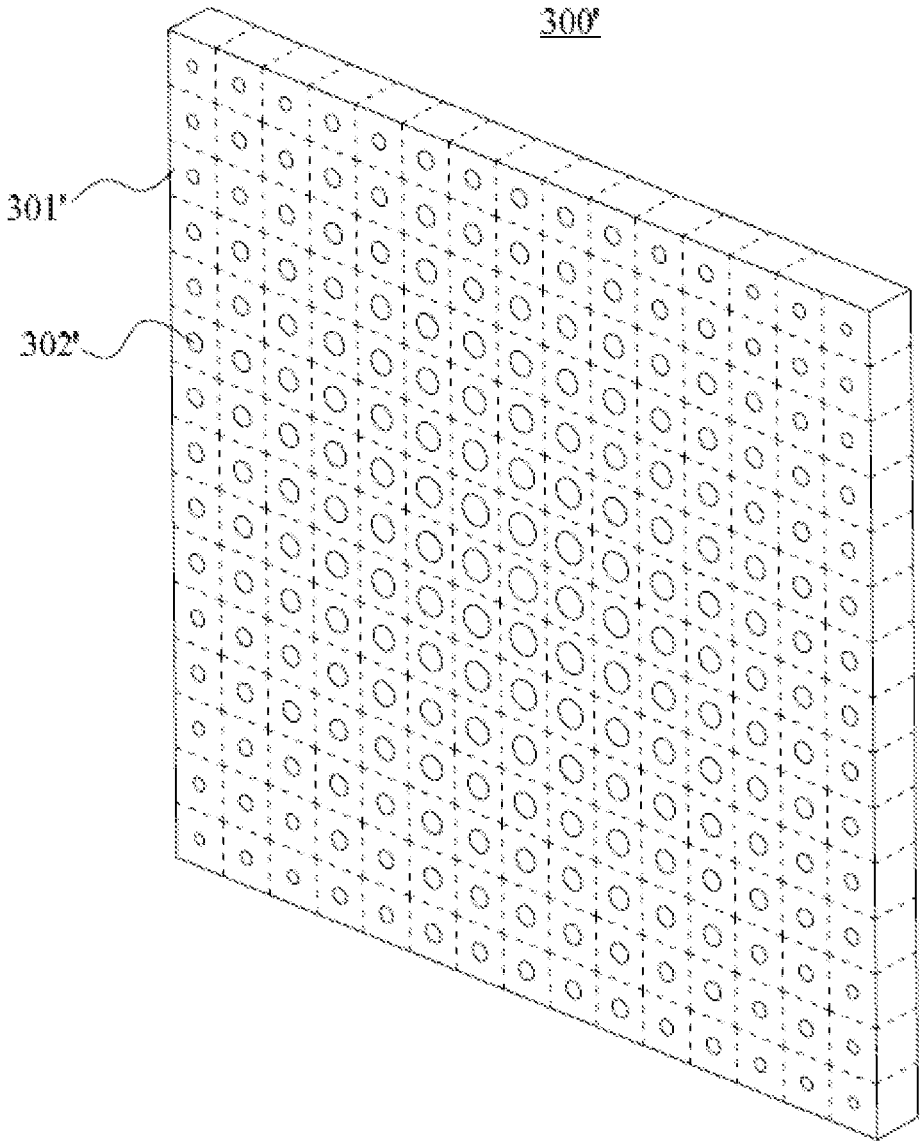
FIG. 13 is a schematic structural view of a first metamaterial sheet forming a first metamaterial panel in the back-feed microwave antenna according to the second embodiment of the present invention.

The first metamaterial panel 30' may be directly attached to a radiation port of the radiation source 20. However, when the first metamaterial panel 30' is directly attached to the radiation port of the radiation source 20, the electromagnetic waves radiated from the radiation source 20 may be partially reflected by the first metamaterial panel 30', which causes energy loss. Therefore, in the present invention, the first metamaterial panel 30' is fixed in front of the radiation source 20 by using a bracket 60. The first metamaterial panel 30' consists of a plurality of first metamaterial sheets 300 having the same refractive index distribution. As shown in FIG. 13, FIG. 13 is a schematic three-dimensional structural view of the first metamaterial sheet 300' according to the second embodiment of the present invention. The first metamaterial sheet 300' comprises a first substrate 301' and a plurality of third artificial porous structures 302' periodically arranged on the first substrate. In the present invention, a thickness of the first metamaterial sheet 300 is 1/10 of a wavelength of an incident electromagnetic wave.

The basic units forming the first metamaterial sheet 300' are still as shown in FIG. 11, but the first metamaterial sheet 300' needs to have a function of diverging the electromagnetic waves. Based on theory of electromagnetism, the electromagnetic waves deflect towards the direction with a large refractive index. Therefore, a variation rule of refractive indexes of the first metamaterial sheet 300 is that: the refractive indexes of the first metamaterial sheet 300' are distributed in a form of circle, a refractive index at the circle center is minimum, the refractive index of a corresponding radius increases with the increase of the radius, and refractive indexes at the same radius are the same. The first metamaterial sheet 300' having this type of refractive index distribution diverges the electromagnetic waves radiated from the radiation source 20, thereby improving the near field radiation range of the radiation source, so that the back-feed microwave antenna may have a smaller overall size.

More specifically, in the present invention, the refractive index distribution rule of the first metamaterial sheet 300' may be linear variation, that is, $n_{(R)}=n_{min}+KR$, where K is a constant, R is a wiring distance between a central point of the metamaterial basic units, which have third artificial porous structures and are distributed in a form of circle, and a central point of the first substrate, and $n_{min}$ is a refractive index value of the central point of the first substrate. In addition, the refractive index distribution rule of the first metamaterial sheet 300' may also be square variation, that is, $n_{(R)}=n_{min}+KR^2$; or cubic variation, that is, $n_{(R)}=n_{min}+KR^3$; or power function variation, that is, $n_{(R)}=n_{min}*K^R$. It can be known from the formula for the variation of the first metamaterial sheet 300' that, the formula can be used as long as the first metamaterial sheet 300' can diverge the electromagnetic waves emitted by the radiation source.

Figure 14:
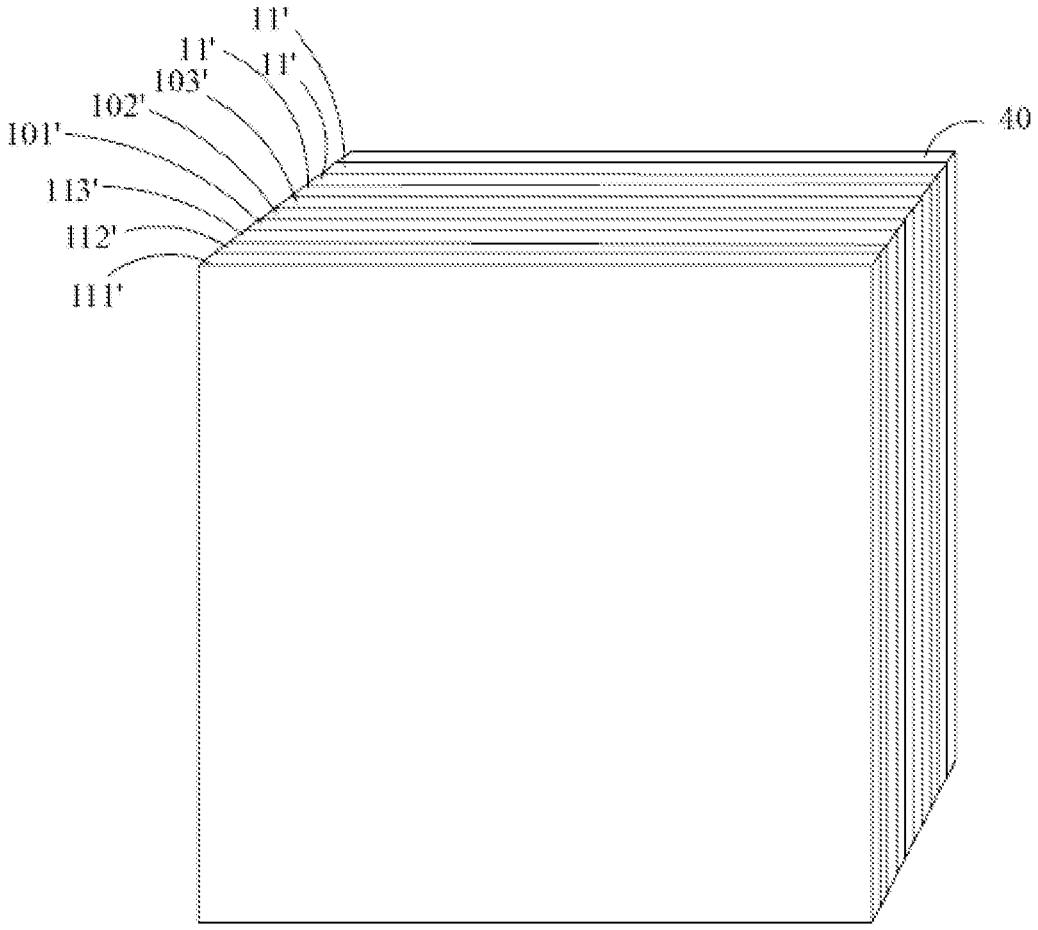
FIG. 14 is a schematic three-dimensional structural view of a second metamaterial panel in the back-feed microwave antenna according to the second embodiment of the present invention.

The second metamaterial panel of the back-feed microwave antenna of the present invention will be described in detail below. The second metamaterial panel converges the electromagnetic waves diverged by the first metamaterial panel, and then the diverged spherical electromagnetic waves are radiated out in a form of plane electromagnetic waves which are more suitable for long distance transmission. As shown in FIG. 14, FIG. 14 is a schematic three-dimensional structural view of the second metamaterial panel according to the second embodiment of the present invention. In FIG. 14, the second metamaterial panel 10' comprises a core layer, wherein the core layer consists of a plurality of core metamaterial sheets 11' having the same refractive index distribution; and a first gradient metamaterial sheet 101' to an $N^{th}$ gradient metamaterial sheet symmetrically arranged at both sides of the core layer. In this embodiment, the gradient metamaterial sheets are a first gradient metamaterial sheet 101', a second gradient metamaterial sheet 102' and a third gradient metamaterial sheet 103'. All the gradient metamaterial sheets and all the core metamaterial sheets form a functional layer of the second metamaterial panel. The second metamaterial panel 10' comprises a first matching layer 111' to an $M^{th}$ matching layer symmetrically arranged at both sides of the functional layer. The refractive index distribution of each matching layer is uniform, a refractive index of the first matching layer 111', which is close to free space, is substantially equal to a refractive index of the free space, and a refractive index of the last matching layer, which is close to the first gradient metamaterial sheet, is substantially equal to the minimum refractive index of the first gradient metamaterial sheet 101'. Both the gradient metamaterial sheets and the matching layers have the functions of reducing reflection of electromagnetic waves and impedance matching and phase compensation. Therefore, providing the gradient metamaterial sheets and the matching layers is a preferable implementation manner.

Figure 15:
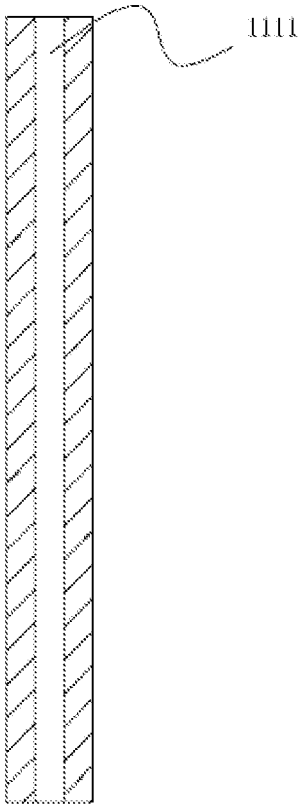
FIG. 15 is a section view of a matching layer of the second metamaterial panel in the back-feed microwave antenna according to the second embodiment of the present invention.

In this embodiment, the matching layer is composed of a lamella having a cavity 1111. The larger the volume of the cavity, the smaller the refractive index of the lamella will be. The refractive index of each matching layer gradually changes as the volume of the cavity gradually changes. A section view of the matching layer is shown in FIG. 15.

The basic units forming the core metamaterial sheets and the gradient metamaterial sheet are as shown in FIG. 11.

Both the core metamaterial sheet and the gradient metamaterial sheet are divided into a circular area and a plurality of annular areas concentric with the circular area, refractive indexes of the circular area and the annular area continuously decrease from the maximum refractive index of each lamella to n0 with the increase of the radius, and refractive index values of metamaterial basic units at the same radius are the same. The maximum refractive index of the core metamaterial sheet is $n_p$, the maximum refractive indexes of the first gradient metamaterial sheet to the $N^{th}$ gradient metamaterial sheet respectively are $n_1, n_2, n_3, \ldots n_n$, where $n_0<n_1<n_2<n_3< \ldots <n_n<n_p$. Start radii and end radii of the circular areas and annular areas concentric with the circular areas divided on all the gradient metamaterial sheets and all the core metamaterial sheets are the same. A refractive index distribution relational expression of each gradient metamaterial sheet and all the core metamaterial sheets with the variation of a radius r is:

$$n_i(r) = \frac{i*n_p}{N+1} - \left(\frac{i}{(N+1)*d}\right)*\left(\sqrt{r^2+s^2} - \sqrt{L(j)^2+s^2}\right)*\frac{\left(n_p - \frac{N+1}{i}*n_0\right)}{n_p - n_0},$$

where an i value corresponding to the first gradient metamaterial sheet to the $N^{th}$ gradient metamaterial sheet is a number from 1 to N, all the i values corresponding to the core layer are N+1, s is a vertical distance from the radiation source to the first gradient metamaterial sheet, d is a total thickness of the first gradient metamaterial sheet to the $N^{th}$ gradient metamaterial sheet and all the core metamaterial sheets, $$d = \frac{\lambda}{n_p - n_0},$$

where λ is an operating wavelength of the second metamaterial panel. The operating wavelength of the second metamaterial panel is determined in practice. It can be known from the description for the metamaterial sheets that, in this embodiment, a thickness of each metamaterial sheet is 0.818 mm. The value of d may be determined after the operating wavelength of the second metamaterial panel is determined, so that the number of the metamaterial sheets manufactured in practice can be obtained. L(j) represents a start radius value of the circular areas on the core metamaterial sheets and the gradient metamaterial sheets and the plurality of annular areas concentric with the circular areas, and j represents which area, where L(1) represents a first area, namely, L(1)=0 in the circular area.

A preferred method for determining the L(j) will be discussed below. Electromagnetic waves radiated from the radiation source are incident into the first gradient metamaterial sheet. Optical paths passed by the electromagnetic waves incident into the first gradient metamaterial sheet are not equal because of different emergence angles. s is a vertical distance from the radiation source to the first gradient metamaterial sheet, and also is the shortest optical path passed by the electromagnetic waves incident into the first gradient metamaterial sheet. At this time, the incidence point corresponds to the circular area start radius of the first gradient metamaterial sheet. That is, when j=1, correspondingly L(1)=0. When a certain beam of electromagnetic waves emitted by the radiation source is incident into the first gradient metamaterial sheet, and the optical path it passed is s+λ, a distance between the incident point of this beam of electromagnetic waves and the incidence point of vertical incidence is the start radius of the first annular area of the plurality of annular areas, and is also an end radius of the circular area. It can be known based on the mathematical formula that, when j=2, the correspondingly $L(2)=\sqrt{(s+\lambda)^2-s^2}$, where λ is a wavelength value of an incident electromagnetic wave. When a certain beam of electromagnetic waves emitted by the radiation source is incident into the first gradient metamaterial sheet, and the optical path it passed is s+2λ, a distance between the incident point of this beam of electromagnetic waves and the incidence point of vertical incidence is the start radius of the second annular area of the plurality of annular areas, and is also an end radius of the first annular area. It can be known based on the mathematical formula that, when j=3, correspondingly $L(3)=\sqrt{(s+2\lambda)^2-s^2}$. In a similar manner, the start radii and end radii of the circular area and the annular areas concentric with the circular area can be known.

The variation rule is the same as the description made for the embodiment in FIG. 6, and details are not described herein again.

The overall refractive index distribution relationship between the first metamaterial panel and the second metamaterial panel are discussed in detail above. It can be known from the metamaterial principle that, the volume of the artificial porous structure on the substrate directly determine refractive index values of different points of the metamaterial. In addition, it can be known from experiments that, when the artificial porous structure is filled with a medium with a refractive index smaller than that of the substrate, the larger the volume of the artificial porous structure, the smaller the refractive index of the corresponding metamaterial basic unit will be. In the present invention, an arrangement rule of the third artificial porous structures on the first metamaterial sheet forming the first metamaterial panel is that: the third artificial porous structure is filled with a medium with a refractive index smaller than a refractive index of the first substrate, basic units of the first metamaterial sheet are distributed in a form of circle on the first substrate with a circle center of the central point of the first substrate, the volume of the third artificial porous structure, which is on the basic units of the first metamaterial sheet and at the circle center, is maximum, the volume of the third artificial porous structure of a corresponding radius increases with the increase of the radius, and volumes of third artificial porous structures at the same radius are the same. An arrangement rule of the second artificial porous structures on the gradient metamaterial sheet is that: the second artificial porous structure is filled with a medium with a refractive index smaller than a refractive index of the gradient metamaterial sheet substrate, the gradient metamaterial sheet substrate comprises a circular area with a circle center of a central point of the gradient metamaterial sheet substrate and a plurality of annular areas concentric with the circular area, variation ranges of volumes occupied by the second artificial porous structures in the circular area and the annular areas in the basic units of the gradient metamaterial sheet are the same, wherein the volumes occupied by the second artificial porous structures in the basic units of the gradient metamaterial sheet continuously increase from the minimum volume to the maximum volume with the increase of the radius, and the volumes at the same radius, which are occupied by the second artificial porous structures in the basic units of the gradient metamaterial sheet, are the same. An arrangement rule of the first artificial porous structures on the core metamaterial sheet is that: the first artificial porous structure is filled with a medium with a refractive index smaller than the refractive index of the core metamaterial sheet, the core metamaterial sheet substrate comprises a circular area with a circle center of a central point of the core metamaterial sheet substrate and a plurality of annular areas concentric with the circular area, variation ranges of volumes occupied by the first artificial porous structures in the circular area and the annular areas in the basic units of the core metamaterial sheet are the same, wherein the volumes occupied by the first artificial porous structures in the basic units of the core metamaterial sheet continuously increase from the minimum volume to the maximum volume with the increase of the radius, and the volumes at the same radius, which are occupied by the first artificial porous structures in the basic units of the core metamaterial sheet, are the same. The above medium, which is filled inside the first artificial porous structure, the second artificial porous structure and third artificial porous structure, and has the refractive index smaller than the refractive index of the substrate is air.

It can be imagined that, when the first artificial porous structure, the second artificial porous structure or the third artificial porous structure is filled with a medium with a refractive index larger than the refractive index of the substrate, the arrangement rule of the volumes of the artificial pores is merely opposite to the above arrangement rule.

Shapes of the artificial porous structures that meet the above refractive index distribution requirements of the first metamaterial panel and the second metamaterial panel are not limited, as long as the volumes occupied in the metamaterial basic units meet the above arrangement rule. In addition, a plurality of artificial porous structures with a same volume may also be formed in each metamaterial basic unit. In this case, it is required that a sum of all the artificial pore volumes of each metamaterial basic unit meets the above arrangement rule.

The embodiments of the present invention have been described with reference to the attached drawings; however, the present invention is not limited to the such embodiments. These embodiments are merely illustrative but are not intended to limit the present invention. Persons of ordinary skill in the art may further derive many other embodiments according to the teachings of the present invention and within the scope defined in the claims, and all of the embodiments shall fall within the scope of the present invention.

What is claimed is:

1. A back-feed microwave antenna, comprising: a radiation source, a first metamaterial panel for diverging electromagnetic waves emitted by the radiation source, and a second metamaterial panel for converting the electromagnetic waves from the first metamaterial panel into plane waves; wherein the first metamaterial panel comprises a first substrate and a plurality of third artificial metal microstructures or third artificial porous structures periodically arranged on the first substrate; the second metamaterial panel comprises a core layer, the core layer comprises a plurality of core metamaterial sheets having the same refractive index distribution, each core metamaterial sheet comprises a core metamaterial sheet substrate and a plurality of first artificial metal microstructures or first artificial porous structures periodically arranged on the core metamaterial sheet substrate, and each core metamaterial sheet comprises a circular area with a circle center in a center of the core metamaterial sheet substrate and a plurality of annular areas concentric with the circular area, refractive index variation ranges in the circular area and the annular areas are the same, wherein refractive indexes in the circular area and the annular areas continuously decrease from a maximum refractive index $n_p$ of the core metamaterial sheet to a minimum refractive index $n_0$ of the core metamaterial sheet with the increase of a radius, and refractive indexes at the same radius are the same, wherein the second metamaterial panel further comprises a first gradient metamaterial sheet to an $N^{th}$ gradient metamaterial sheet symmetrically arranged at both sides of the core layer, each of the gradient metamaterial sheets comprises a gradient metamaterial sheet substrate and a plurality of second artificial metal microstructures periodically arranged on a surface of the gradient metamaterial sheet substrate, and all the gradient metamaterial sheets and all the core metamaterial sheets form a functional layer of the second metamaterial panel; wherein two symmetrically arranged $N^{th}$ gradient metamaterial sheets are close to the core layer; maximum refractive indexes of the first gradient metamaterial sheet to the $N^{th}$ gradient metamaterial sheet respectively are $n_0, n_1, n_2, n_3, \ldots, n_n$, where $n_0<n_1<n_2<n_3 \ldots <n_n<n_p$; a maximum refractive index of an $a^{th}$, $a^{th}=1, 2, 3, \ldots, N^{th}$, gradient metamaterial sheet is $n_a$, the $a^{th}$ gradient metamaterial sheet comprises a circular area with a circle center in a center of an $a^{th}$ gradient metamaterial sheet substrate and a plurality of annular areas concentric with the circular area, where the refractive indexes in the circular area and the annular areas continuously decrease from a maximum refractive index $n_a$ of the $a^{th}$ gradient metamaterial sheet to the same minimum refractive index $n_0$ of all the gradient metamaterial sheets and core metamaterial sheets with the increase of the radius, and refractive indexes at the same radius are the same, wherein the second metamaterial panel further comprises a first matching layer to an $M^{th}$ matching layer symmetrically arranged at both sides of the functional layer, wherein two symmetrically arranged $M^{th}$ matching layers are close to the first gradient metamaterial sheet refractive index distribution of each matching layer is uniform, a refractive index of the first matching layer, which is close to the free space, is substantially equal to a refractive index of the free space, and a refractive index of the $M^{th}$ matching layer, which is close to the first gradient metamaterial sheet, is substantially equal to the minimum refractive index $n_0$ of the first gradient metamaterial sheet, wherein each of the matching layers comprises a second substrate and a coating layer, and wherein air is filled fully between the coating layer and the second substrate, a duty ratio of air is changed by changing a space between the coating layer and the second substrate, thereby enabling the matching layers to have different refractive indexes.

2. The back-feed microwave antenna according to claim 1, wherein start radii and end radii of the circular areas and annular areas concentric with the circular areas divided on all the gradient metamaterial sheets and all the core metamaterial sheets are the same; and a refractive index distribution relational expression of each gradient metamaterial sheet and all the core metamaterial sheets with the variation of a radius r is:

$$n_i(r) = \frac{i*n_p}{N+1} - \left(\frac{i}{(N+1)*d}\right)*\left(\sqrt{r^2+s^2} - \sqrt{L(j)^2+s^2}\right)*\frac{\left(n_p - \frac{N+1}{i}*n_0\right)}{n_p - n_0},$$

where an i value corresponding to the first gradient metamaterial sheet to the $N^{th}$ gradient metamaterial sheet is a number from 1 to N, all the i values corresponding to the core metamaterial sheets are N+1, s is a vertical distance from the radiation source to the first gradient metamaterial sheet, d is a total thickness of the first gradient metamaterial sheet to the $N^{th}$ gradient metamaterial sheet and all the core metamaterial sheets, $$d = \frac{\lambda}{n_p - n_0},$$

where λ is an operating wavelength of the second metamaterial panel; L(j) represents a start radius value of the circular areas on the core metamaterial sheets and the gradient metamaterial sheets and the plurality of annular areas concentric with the circular areas, and j represents which area, where L(1) represents a first area, namely, L(1)=0 in the circular area.

3. The back-feed microwave antenna according to claim 2, wherein a size variation rule of the plurality of the first artificial metal microstructures periodically arranged on the core metamaterial sheet substrate is that: the plurality of the first artificial metal microstructures are same in geometric shape, wherein the sizes in the circular area and the annular areas of the core metamaterial sheet substrate continuously decrease from the maximum size to the minimum size with the increase of the radius, and sizes of first artificial metal microstructures at the same radius are the same.

4. The back-feed microwave antenna according to claim 2, wherein a first gradient metamaterial sheet to a third gradient metamaterial sheet are symmetrically arranged at both sides of the core layer; a size variation rule of the second artificial metal microstructures periodically arranged on the gradient metamaterial sheet substrate is that: a plurality of the second artificial metal microstructures are same in geometric shape, wherein sizes in the circular area and the annular areas of the gradient metamaterial sheet substrate continuously decrease from the maximum size to the minimum size with the increase of the radius, and sizes of second artificial metal microstructures at the same radius are the same.

5. The back-feed microwave antenna according to claim 2, wherein the first artificial porous structure is filled with a medium with a refractive index smaller than a refractive index of the core metamaterial sheet substrate, an arrangement rule of the plurality of first artificial porous structures periodically arranged on the core metamaterial sheet substrate is that: volumes of the first artificial porous structures in the circular area and the annular areas of the core metamaterial sheet substrate continuously increase from the minimum volume to the maximum volume with the increase of the radius, and first artificial pore volumes at the same radius are the same.

6. The back-feed microwave antenna according to claim 2, wherein the first artificial porous structure is filled with a medium with a refractive index larger than a refractive index of the core metamaterial sheet substrate, an arrangement rule of the plurality of first artificial porous structures periodically arranged on the core metamaterial sheet substrate is that: volumes of the first artificial porous structures in the circular area and the annular areas of the core metamaterial sheet substrate continuously decrease from the maximum volume to the minimum volume with the increase of the radius, and first artificial pore volumes at the same radius are the same.

7. The back-feed microwave antenna according to claim 2, wherein the second artificial porous structure is filled with a medium with a refractive index smaller than a refractive index of the gradient metamaterial sheet substrate, and an arrangement rule of the second artificial porous structures periodically arranged on the gradient metamaterial sheet substrate is that: volumes of the second artificial porous structures in the circular area and the annular areas of the gradient metamaterial sheet substrate continuously increase from the minimum volume to the maximum volume with the increase of the radius, and second artificial pore volumes at the same radius are the same.

8. The back-feed microwave antenna according to claim 1, wherein the plurality of first artificial metal microstructures, the plurality of second artificial metal microstructures and the plurality of third artificial metal microstructures have a same geometric shape.

9. The back-feed microwave antenna according to claim 8, wherein the geometric shape is an "I" shape, which comprises an upright first metal branch and second metal branches that are at both sides of the first metal branch and are perpendicular to the first metal branch.

10. The back-feed microwave antenna according to claim 9, wherein the geometric shape further comprises third metal branches that are at both ends of the second metal branches and are perpendicular to the second metal branches.

11. The back-feed microwave antenna according to claim 8, wherein the geometric shape is in a planar snowflake type, which comprises two mutually perpendicular first metal branches and second metal branches that are at both sides of the first metal branches and are perpendicular to the first metal branches.

12. The back-feed microwave antenna according to claim 1, wherein refractive indexes of the first metamaterial panel are distributed in a form of circle with a circle center of a central point of the first metamaterial panel, a refractive index at the circle center is minimum, the refractive index of a corresponding radius increases with the increase of the radius, and refractive indexes at the same radius are the same.

13. The back-feed microwave antenna according to claim 12, wherein the first metamaterial panel consists of a plurality of first metamaterial sheets having the same refractive index distribution; the third artificial metal microstructures are distributed in a form of circle on the first substrate with a circle center of a central point of the first metamaterial panel, a size of the third artificial metal microstructure at the circle center is minimum, sizes of third artificial metal microstructures at a corresponding radius increase with the increase of the radius, and sizes of third artificial metal microstructures at the same radius are the same.

14. The back-feed microwave antenna according to claim 12, wherein the first metamaterial panel consists of a plurality of first metamaterial sheets having the same refractive index distribution; the third artificial porous structure is filled with a medium with a refractive index smaller than a refractive index of the first substrate, an arrangement the rule of third artificial porous structures periodically arranged on the first substrate is that: the central point of the first metamaterial panel is taken as the circle center, a volume of the third artificial porous structure at the circle center is minimum, volumes of third artificial porous structures at the same radius are the same, and third artificial porous structure volumes increase with the increase of the radius.

15. The back-feed microwave antenna according to claim 1, wherein the back-feed microwave antenna further comprises a housing, wherein the housing and the second metamaterial panel form a sealed cavity, and a wave-absorbing material is further attached inside a housing wall connected with the second metamaterial panel.

16. The back-feed microwave antenna according to claim 1, wherein the first metamaterial panel is fixed in front of the radiation source by using a bracket, and a distance from the radiation source to the first metamaterial panel is 30 cm.

* * * * *